US006065453A

United States Patent [19]

Zych

[11] Patent Number: 6,065,453

[45] Date of Patent: May 23, 2000

[54] DEVICE FOR AVOIDING CAVITATION IN INJECTION PUMPS

[75] Inventor: Edmond Zych, Aulnay-sous-Bois, France

[73] Assignee: S.E.M.T. Pielstick, Saint Denis, France

[21] Appl. No.: 09/238,505

[22] Filed: Jan. 27, 1999

[30] Foreign Application Priority Data

Jan. 27, 1998 [FR] France ..... 98 00836

[51] Int. Cl.[7] ..... F02M 37/04

[52] U.S. Cl. ..... 123/514; 123/516; 123/506

[58] Field of Search ..... 123/506, 514, 123/516, 510–11, 447; 417/494, 499

[56] References Cited

U.S. PATENT DOCUMENTS

| | | | |
|---|---|---|---|
| 4,118,156 | 10/1978 | Ivosevic | 417/494 |
| 4,459,964 | 7/1984 | Straubel et al. | 123/514 |
| 4,940,037 | 7/1990 | Eckert | 123/506 |
| 5,015,160 | 5/1991 | Hlousek et al. | 417/499 |
| 5,285,759 | 2/1994 | Terada et al. | 123/514 |
| 5,626,121 | 5/1997 | Kushida et al. | 123/514 |
| 5,749,345 | 5/1998 | Treml | 123/514 |

FOREIGN PATENT DOCUMENTS 8 296528 11/1996 Japan .

*Primary Examiner*—Thomas N. Moulis
*Attorney, Agent, or Firm*—Sughrue, Mion, Zinn, Macpeak & Seas, PLLC

[57] ABSTRACT

The invention provides a device for eliminating cavitation in the excess fuel return orifice(s) in the compression chamber of a fuel injection pump of an internal combustion engine after the end of the injection stage, said injection pump being connected firstly to a feed duct including a first check valve having low headloss enabling fuel to reach the compression chamber, and secondly to an excess fuel return duct, wherein the return duct comprises in parallel and close to the return orifice of the injection pump, a second check valve that is rated to cause the pressure in said return orifice of the injection pump to rise, and a two-port valve that is normally open and that is caused to close by the appearance of pressure in the return orifice greater than the pressure which obtains in the feed duct upstream from said first check valve.

3 Claims, 2 Drawing Sheets

DEVICE FOR AVOIDING CAVITATION IN INJECTION PUMPS

The present invention relates to a device designed to eliminate cavitation in the excess fuel return orifice(s) in the compression chamber of a fuel injection pump of an internal combustion engine after the end of the injection stage.

BACKGROUND OF THE INVENTION

This stage in the operation of an injection pump, referred to as "emptying", causes excess fuel to be expelled at very high pressure and at very high speed through return orifices where the fuel that is already present is at low pressure. At the interface between the jet of expelled fuel and the fuel at low pressure, this gives rise to the appearance of bubbles due to degassing which, combined with the travel speed, give rise to erosion of the walls of the return orifices by cavitation, which erosion can lead to destruction of the injection pump. One of the means for eliminating this cavitation is to increase the pressure which obtains in the return orifices of an injection pump when emptying takes place. Devices are known such as that described in document JP08296528 which teaches placing a check valve upstream from the feed to the injection pump and two rated valves downstream from the injection pump, one of the rates valves having a high rating and enabling a large flow rate and the other rated valve having a low rating for passing a low flow rate. In addition, at least one of the rated valves includes an orifice to guarantee continuous circulation of fuel. The drawback of that device is that the permanent link does not enable high and sufficient pressure to be maintained in the orifices before emptying takes place. This pressure arises only when the emptying flow appears, and that is not sufficient for avoiding orifice erosion effectively.

OBJECTS AND SUMMARY OF THE INVENTION

The invention proposes remedying those drawbacks by providing a device for eliminating cavitation in the excess fuel return orifice(s) in the compression chamber of a fuel injection pump of an internal combustion engine after the end of the injection stage, said injection pump being connected firstly to a feed duct including a first check valve having low headloss enabling fuel to reach the compression chamber, and secondly to an excess fuel return duct, wherein the return duct comprises in parallel and close to the return orifice of the injection pump, a second check valve that is rated to cause the pressure in said return orifice of the injection pump to rise, and a two-port valve that is normally open and that is caused to close by the appearance of pressure in the return orifice greater than the pressure which obtains in the feed duct upstream from said first check valve.

According to another characteristic of the invention, the two-port valve is provided with a spring causing said valve to open when the pressure obtaining upstream from the first check valve is substantially equal to the pressure which obtains in the return orifice.

According to yet another characteristic of the invention, the return duct includes a parallel-connected accumulator upstream from the rated, second check valve and the two-port valve.

The invention also provides the use of said device for implementing fuel injection in an internal combustion engine.

The advantages of the device lie in reduced wear of the components of the injection pump, thus making it possible to perform maintenance at reduced frequency and minimizing the dispersion of metal particles in the fuel.

BRIEF DESCRIPTION OF THE DRAWINGS

By way of non-limiting example.

MORE DETAILED DESCRIPTION

Figure 1:
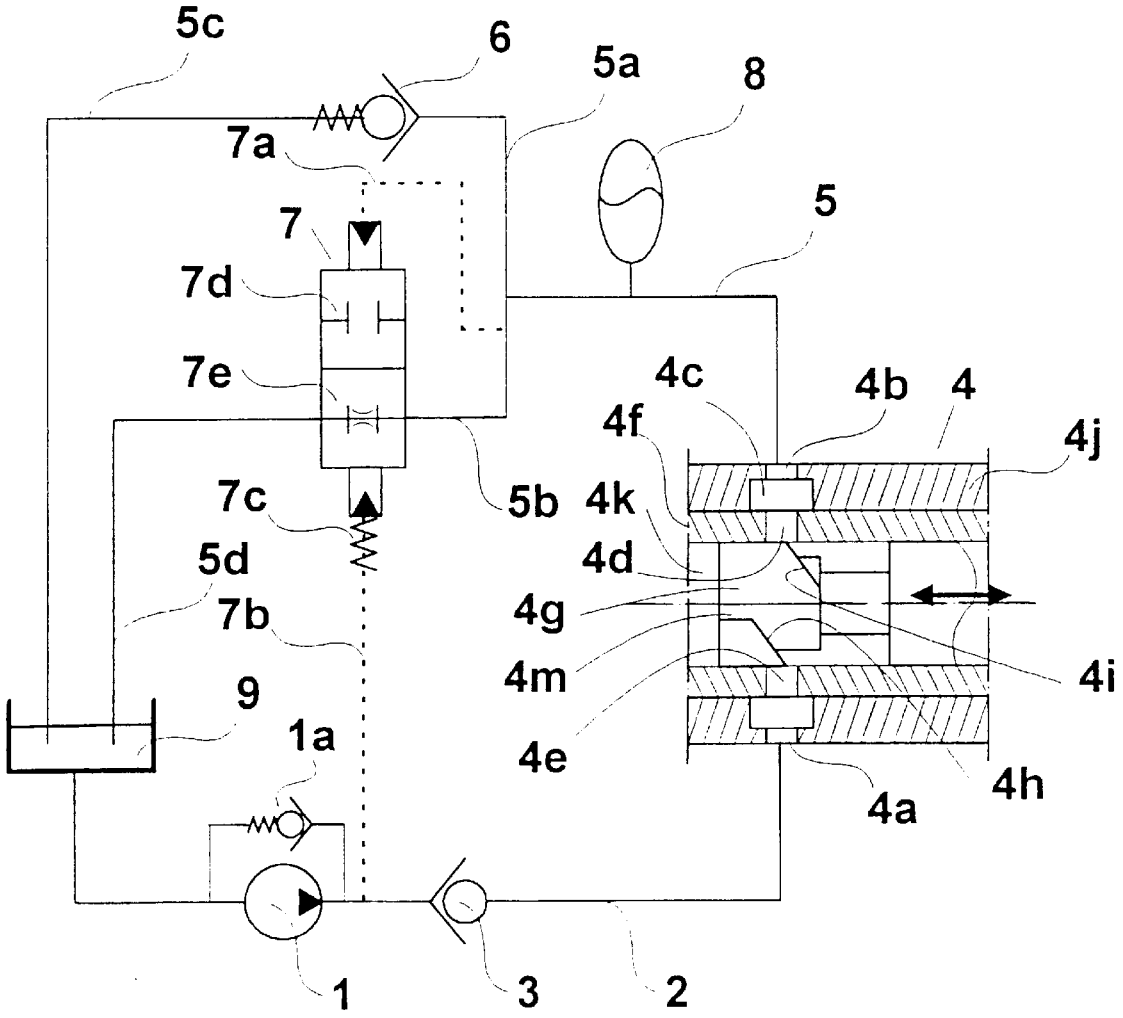
FIG. 1 is a diagram of a device of the invention.

In FIG. 1, a duct 2 provided with a check valve 3 connects a fuel circulation pump 1 fed from a tank 9 to a fuel injection pump 4 shown in part only, being represented by its feed orifice 4*a*. The delivery pressure of the pump 1 is limited by a rated check valve 1*a*. The main return duct 5 and the secondary ducts 5*a* and 5*b* connect the return orifice 4*b* of the injection pump 4 in parallel to a rated check valve 6 and to a two-port valve 7. The two-part valve 7 is pilot controlled via a line 7*a* by the pressure which obtains in the duct 5*b,* and via a line 7*b* by the pressure which obtains in the duct 2 upstream from the rated check valve 3. A spring 7*c* reinforces the pilot control action due to the pressure in the line 7*b,* and holds the valve 7 in the open position in the absence of a large pressure difference between the two pilot lines. In the position 7*e,* the valve 7 puts into operation a restriction that gives rise to headloss for maintaining a certain level of fuel pressure upstream from the valve 7. The orifices 4*a* and 4*b* are put selectively into communication with the compression chamber 4*k* of the injection port 4 by means of a peripheral groove 4*c* of the envelope 4*j* and orifices 4*d* and 4*e* of the piston jacket 4*f* as a function of the movements of the piston 4*g* which has edges 4*h* and 4*i* for interrupting delivery. A small volume pressure accumulator 8 is installed on the duct 5 immediately downstream from the return orifice 4*b*. The rated check valve 6 and the two-port valve 7 are connected to the tank 9 via ducts 5*c* and 5*d*.

Figure 2:
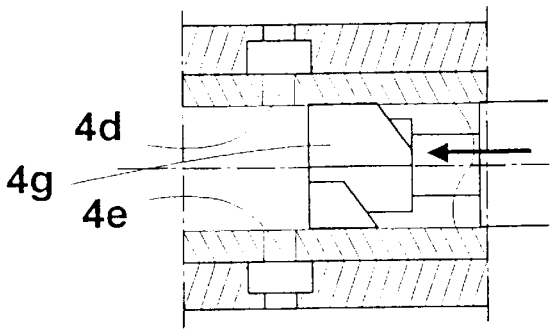
FIGS. 2, 3, and 4 show the piston of the injection pump at various stages in compression.

In FIG. 2, the piston 4*g* is at bottom dead center and disengages the orifices 4*d* and 4*e* to put them into communication with the compression chamber 4*k*.

Figure 3:
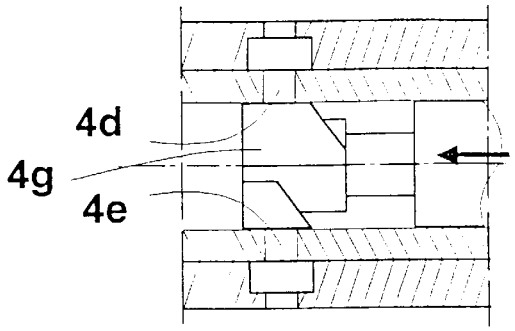

In FIG. 3, the piston 4*g* is substantially halfway along its stroke and it closes the orifices 4*d* and 4*e,* thereby interrupting communication with the compression chamber 4*k*.

Figure 4:
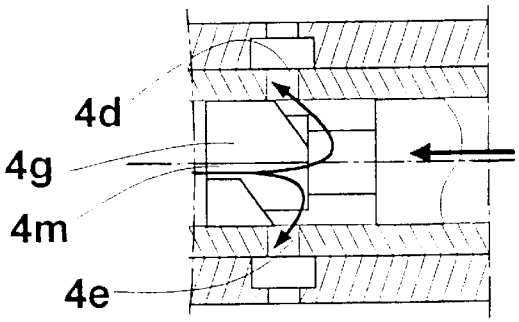

In FIG. 4, the piston 4*g* has continued its stroke, and the edges 4*i* and 4*h* disengage the orifices 4*d* and 4*e,* putting them into communication with the compression chamber 4*k* via a groove 4*m* formed on a generator line in the side wall of the piston 4*g*.

Figure 5:
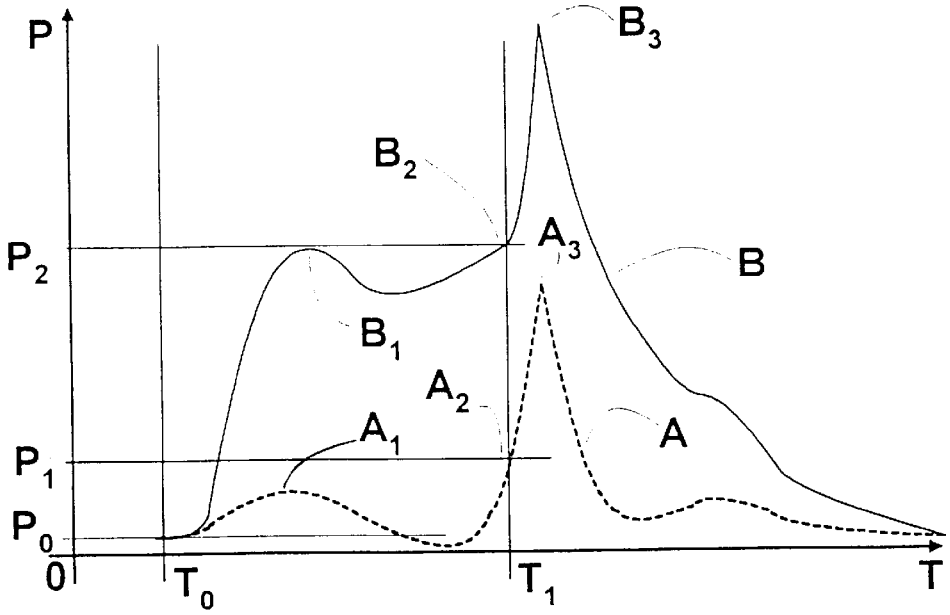
FIG. 5 shows how pressure varies in the return orifices during the injection stages, curve A showing said variation for a pump that does not have the device of the invention, and curve B showing the same variation, but for a pump that is fitted with the device of the invention.

In FIG. 5, a graph having an abscissa T representing time and an ordinate P representing pressure, there can be seen a curve A showing how the pressure of the fuel in the return orifices 4*d* and 4*e* varies during an injection cycle for a pump that is not provided with the device of the invention, and a curve B showing the same variation for a pump that is provided with the device of the invention.

The operation of the device is described below.

The piston 4*g* is at the beginning of its compression stroke, as shown in FIG. 2. The check valve 6 is rated to a pressure lying in the range 50 bars to 100 bars, the damper 8 having an inflation pressure that is slightly smaller than the rated pressure of the check valve 6, and in the absence of a large pressure difference between the ducts 7*a* and 7*b,* the two-port valve 7 is held in its open position 7*e* by the spring 7*c.* The restriction of the valve 7 in its position 7*e* provides circulation pressure of about 3 bars. The fuel supplied by the pump 1 flows along the duct 2 through the check valve 3, the orifice 4*a,* the compression chamber 4*k,* the orifice 4*b,* the two-port valve 7, and returns to the tank 9 via the duct 5*d.* This situation corresponds in FIG. 5 to time $T_0$ of curve B.

The piston 4*g* follows its compression stroke and the high pressure in the duct (not shown) connecting the compression chamber 4*k* to the injector (not shown) causes the check valve 3 to close and fuel to be delivered via the orifice 4*b.* The sudden increase in flow rate in the duct 5*b,* and the headloss in the two-port valve 7, give rise to a significant increase of pressure in the ducts 5*a* and 7*a,* causing the valve 7 to be controlled so as to switch to position 7*d.* Pressure continues to rise in duct 5*a* still it reaches the rated value of check valve 6 which begins to open. Simultaneously, the damper 8 fills and its pressure rises, thereby attenuating the hammer on the check valve 6. This situation corresponds in FIG. 5 to the variation of curve B in the vicinity of point $B_1$.

When the piston 4*g* reaches the position shown in FIG. 3, the orifices 4*a* and 4*b* are closed and the fuel is contained between the check valve 3 and the rated check valve 6 at a pressure close to the rated pressure of the rated check valve 6. This pressure therefore obtains likewise in the circular groove 4*c* and in the orifices 4*d* and 4*e.* Because the compression chamber 4*k* is isolated from the orifices 4*d* and 4*e,* the pressure in said compression chamber can rise until it reaches the value at which injection is to take place, which can be of the order of 1000 bars. This situation corresponds in FIG. 5 to variation in curve B between points $B_1$ and $B_2$.

When the piston 4*g* reaches the positions shown in FIG. 4, the edges 4*h* and 4*i* have uncovered the orifices 4*d* and 4*e,* putting them again into communication with the compression chamber 4*k.* The beginning of this "emptying" opening corresponds to time $T_1$ and to pressure $P_2$ in FIG. 5. This emptying causes fuel to be transferred suddenly through the orifices 4*d* and 4*e* in the form of very high speed jets, giving rise to a rapid rise of pressure in the orifices 4*d* and 4*e,* corresponding to pressure peak $B_3$ in curve B in FIG. 5. The interface of the high speed jet with the fuel already present is the seat of turbulence that generates bubbles of gas if the pressure that obtains in the fuel present in the orifices 4*d* and 4*e* is insufficient, with this being minimized by the high level of the pressure $P_2$ which lies in the range 50 bars to 100 bars.

After reaching top dead center, the piston follows its return stroke to bottom dead center, pressure in the compression chamber 4*k* drops as its volume increases, and when the orifices 4*d* and 4*e* are again in communication with the compression chamber 4*k,* pressure also drops in the entire circuit extending between the check valve 3, the rated check valve 6, and the two-port valve 7. When the pressure in the duct 7*a* is close to the pressure in the duct 7*b,* the spring 7*c* causes the two-port valve 7 to take up position 7*d,* the damper 8 empties, and the cycle can restart.

Curve A in FIG. 5 shows the same operating stages for a pump that is not fitted with a device of the invention. The pressure at point $A_1$ remains close to the pressure $P_0$, i.e. close to a few bars. The pressure $P_1$ at point $A_2$, less than 50 bars, corresponds to the beginning of emptying via the orifices 4*d* and 4*e,* and is insufficient to prevent bubbles of gas forming at the peripheries of the jets. These bubbles strike the walls of the orifices 4*d* and 4*e* and give rise to erosion which destroys the jacket 4*f.* In the device of the invention, the residual pressure maintained in the orifices 4*d* and 4*e* by the rated check valve 6 considerably reduces the formation of gas bubbles and minimizes erosion.

What is claimed is:

1. A device for eliminating cavitation in the excess fuel return orifice(s) in the compression chamber of a fuel injection pump of an internal combustion engine after the end of the injection stage, said injection pump being connected firstly to a feed duct including a first check valve having low headloss enabling fuel to reach the compression chamber, and secondly to an excess fuel return duct, wherein the return duct comprises in parallel and close to the return orifice of the injection pump, a second check valve that is rated to cause the pressure in said return orifice of the injection pump to rise, and a two-port valve that is normally open and that is caused to close by the appearance of pressure in the return orifice greater than the pressure which obtains in the feed duct upstream from said first check valve.

2. A device according to claim 1, wherein the two-port valve is provided with a spring causing said valve to open when the pressure obtaining upstream from the first check valve is substantially equal to the pressure which obtains in the return orifice.

3. A device according to claim 1, wherein the return duct includes a parallel-connected accumulator upstream from the rated, second check valve and the two-port valve.

* * * * *